United States Patent [19]

Roberts

[11] Patent Number: 4,511,257

[45] Date of Patent: Apr. 16, 1985

[54] PUMP POSITION RETAINER APPARATUS

[75] Inventor: James R. Roberts, Grayslake, Ill.

[73] Assignee: A. O. Smith Harvestore Products, Inc., Arlington Heights, Ill.

[21] Appl. No.: 510,214

[22] Filed: Jul. 1, 1983

[51] Int. Cl.[3] ..... B01F 5/12

[52] U.S. Cl. ..... 366/262; 366/286

[58] Field of Search ..... 74/89.2, 89.21, 89.22; 187/81, 82; 254/269, 270, 375; 366/190, 241, 242, 244, 251, 253, 254, 261, 262, 263, 264, 265, 266, 267, 268, 269, 270, 285, 286, 347

[56] References Cited

U.S. PATENT DOCUMENTS

| | | | |
|---|---|---|---|
| 2,619,345 | 11/1952 | Davidson | 74/89.2 |
| 3,704,017 | 11/1972 | Young | 187/81 |
| 4,359,207 | 11/1982 | Maryonovich | 187/81 |
| 4,416,549 | 11/1983 | Kretschmer | 366/264 |

*Primary Examiner*—Robert W. Jenkins
*Assistant Examiner*—Arthur D. Dahlberg
*Attorney, Agent, or Firm*—Andrus, Sceales, Starke & Sawall

[57] ABSTRACT

An apparatus for preventing free descent of a motor-pump unit. The motor-pump unit is mounted within a manure-containing pit for vertical sliding movement on a fixed column, and an elevating mechanism is employed for raising and lowering the pump within the pit and includes a cable having one end which is coiled on a drum while the opposite end of the cable is connected to the motor-pump unit. The weight of the motor-pump unit normally applies substantial tension to the cable. A mechanism is incorporated which is responsive to slackening of the cable and acts to arrest free descent of the motor-pump unit, as well as discontinuing operation of the cable drum mechanism.

11 Claims, 12 Drawing Figures

Fig. 5
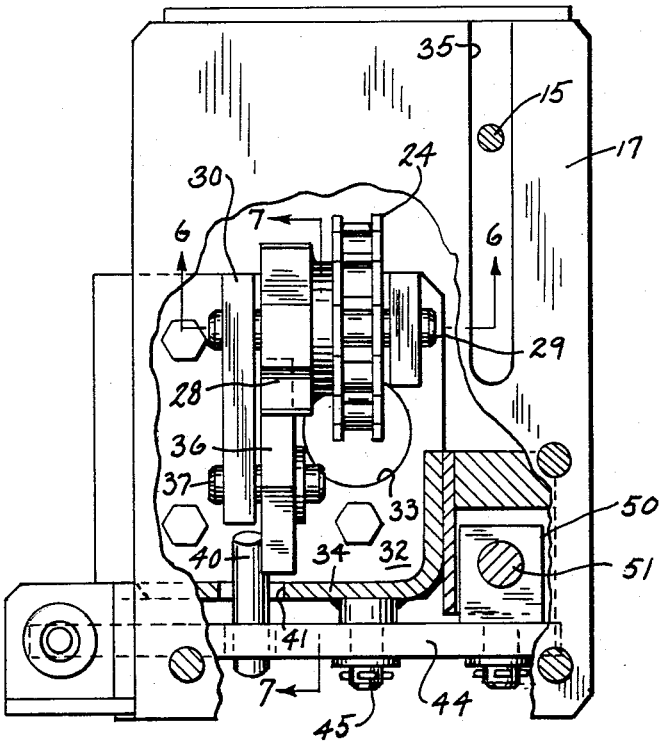
Fig. 6
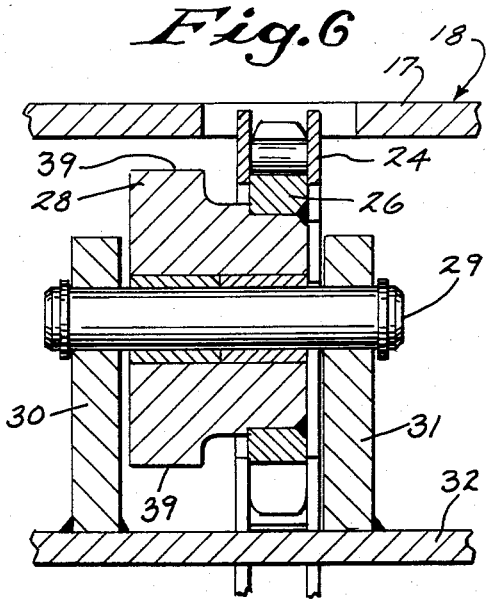
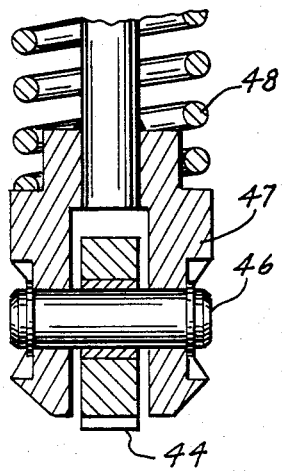
Fig. 8
Fig. 9
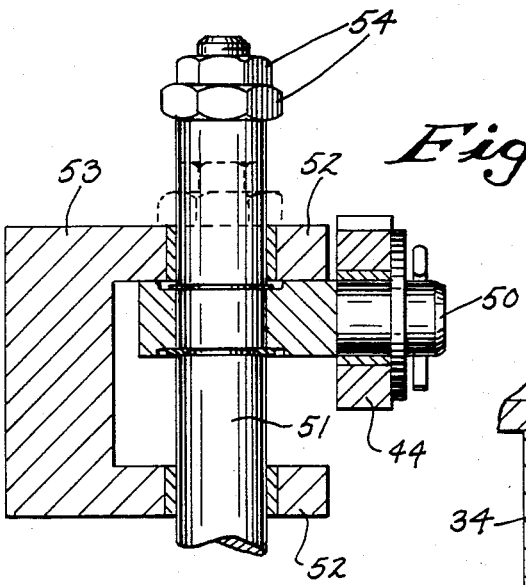
Fig. 7
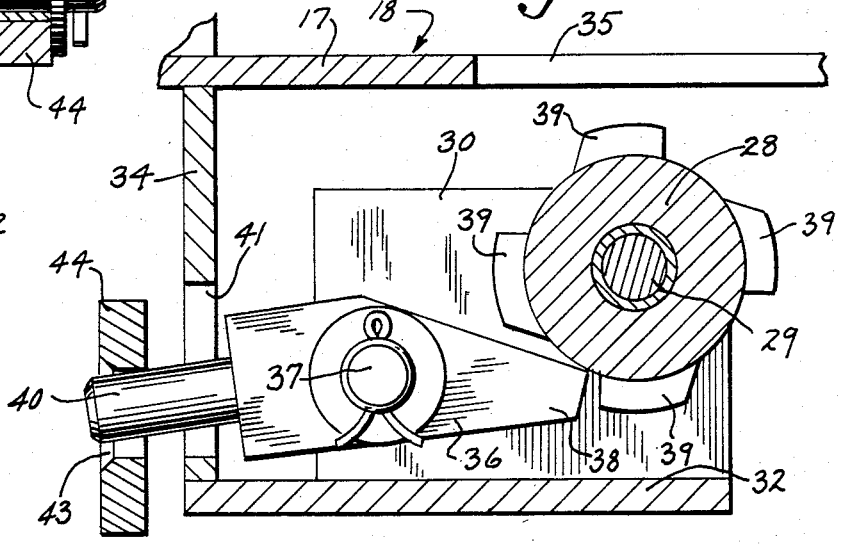

54
61
62
51
82
56
75
70
71
76
74
69
68
72
73
67
66
63a
59
65
63
21
64
60
81
78
86
77
80
57
58
15
44
50
52
5

PUMP POSITION RETAINER APPARATUS

BACKGROUND OF THE INVENTION

In a conventional liquid manure system, manure is delivered by barn cleaners or other conveying apparatus to a below-ground pit adjacent the barn or other livestock feed area. In a conventional system, a pump is located in the pit and acts to selectively mix or homogenize the manure slurry and to deliver the mixed slurry from the pit. In the homogenizing mode of operation, the pump is raised and lowered in the pit and rotated so that the discharge of the pump is directed to all areas of the pit to mix or homogenize the liquid manure slurry. When it is desired to discharge the slurry from the pit, the pump is lowered to a position where the outlet of the pump is automatically connected to a discharge pipe and operation of the pump will then discharge the liquid manure slurry through the discharge pipe to a liquid storage tank or other discharge site.

U.S. patent application Ser. No. 06/327,792, filed Dec. 7, 1981, discloses an agitating and pumping system for liquid manure slurry. In accordance with the invention of that patent application, the pump, which is located within the pit that contains the manure slurry, is operably connected through a vertical drive shaft to a motor, which is positioned above the pit and out of contact with the liquid slurry. The motor-pump unit is mounted for sliding vertical movement within the pit on a fixed column and in addition, can be rotated horizontally about the column. With this arrangement, as disclosed in the aforementioned patent application, the pump can be raised and lowered within the pit, as well as rotated, to thereby direct the discharge of the pump to all areas of the pit to thoroughly mix or homogenize the slurry.

In the aforementioned patent application, the motor-pump unit is raised and lowered through a cable arrangement in which a cable, wound on a drum located at the top of the column, passes over a pulley and is dead-ended on the fixed column. Through power operation of the drum, the motor-pump unit can be raised and lowered within the pit.

With the construction as disclosed in the aforementioned patent application, the motor-pump unit can be raised and lowered through a distance of approximately 6 feet and as the motor-pump unit has substantial weight, generally in the range of about 700 lbs., any malfunction in the system, such as breakage of the cable, can result in a free fall of the motor-pump unit over a substantial distance which could cause considerable damage to the pump or motor. Furthermore, in the event of cable breakage or when the pump is brought to rest, continued operation of the cable drum will result in the unwinding of the cable which can cause entanglement of the cable.

SUMMARY OF THE INVENTION

The invention is directed to an improved pumping system for liquid manure slurry and in particular to a mechanism which will retain the pump in position in the event of a malfunction in the drive mechanism. The motor-pump unit is mounted for sliding movement on a vertical column within the manure pit, and the motor-pump unit can be raised and lowered within the pit by a cable drive mechanism.

In accordance with the invention, a chain passes over a sprocket which is mounted on the upper end of the fixed vertical column and one end of the chain is connected to the motor-pump unit, while the opposite end of the chain is connected to an elongated weight which is mounted for vertical movement within the vertical support column. As the motor-pump unit is raised and lowered through operation of the cable drive system, the chain will correspondingly move on the sprocket.

A mechanism is incorporated which will automatically sense a slackening of the drive cable and will thereby operate to engage the chain and arrest free descent of the motor-pump unit. In this regard, a ratchet wheel is formed integrally with the sprocket and rotates therewith. When the cable slackens, a link is pivoted to thereby operate a pawl and bring the pawl into engagement with one of a number of lugs on the ratchet wheel to thereby stop rotation of the sprocket and the chain. As the chain is connected to the motor-pump unit, locking of the chain will thereby prevent further descent of the motor-pump unit.

The mechanism of the invention serves to prevent the motor-pump unit from accidentally falling into the pit in the event of breakage of the cable or other malfunction of the drive system and thereby eliminates potential damage to the pump and other operating components. The safety mechanism provides a positive lock and will permit only a limited free fall of the motor-pump unit in the range of less than two inches. Once proper tension on the cable is restored, the lock will be automatically released.

The mechanism also acts to discontinue operation of the cable drum on slackening of the cable and thus prevent the cable from unwinding from the drum after the pump has come to rest. During normal operation, the pump may come to rest on the ground above the pit or on the bottom of the pit itself, and continued operation of the drum motor will act to unwind the cable from the drum which could result in a serious entanglement problem. With the present invention, when the pump comes to rest, slackening in the cable will be sensed to automatically shut off the cable drum motor.

Other objects and advantages will appear in the course of the following description.

DESCRIPTION OF THE DRAWINGS

The drawings illustrate the best mode presently contemplated of carrying out the invention.

In the drawings:

FIG. 5 is a top view of the structure shown in FIG. 4, with parts broken away;

FIG. 6 is a section taken along line 6—6 of FIG. 5;

FIG. 7 is a section taken along line 7—7 of FIG. 5;

FIG. 8 is a section taken along line 8—8 of FIG. 4;

FIG. 9 is an enlarged fragmentary section showing the connection of the connecting rod to the lever;

DESCRIPTION OF THE PREFERRED EMBODIMENT

Figure 1:
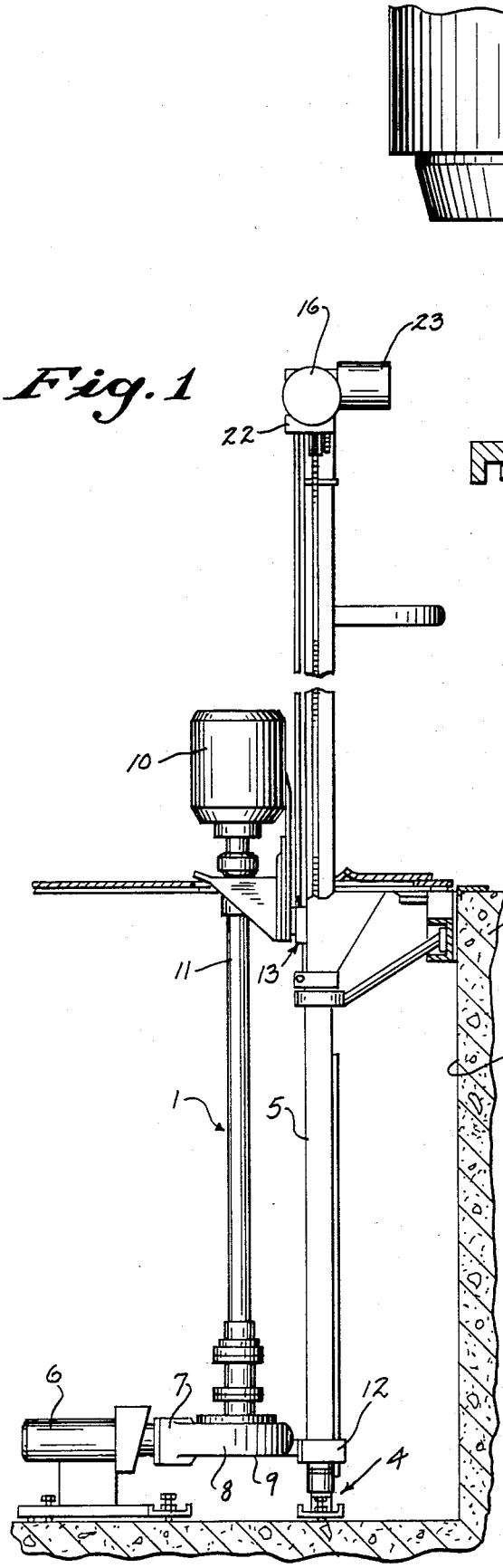
FIG. 1 is a side elevation of the motor-pump unit as installed in a pit.

FIG. 1 illustrates an apparatus 1 for agitating and pumping a liquid slurry, such as liquid manure slurry, and the apparatus 1, in general, is similar to that described in the co-pending U.S. patent application, Ser. No. 06/327,792, filed Dec. 7, 1981, and the construction shown in that patent application is incorporated herein by reference.

The apparatus 1 is mounted within a pit 2 formed in the ground 3 or other foundation, and the apparatus includes a base unit 4 which is located at the bottom of the pit. A vertical column 5, square in cross section, is mounted for rotation about its axis on base unit 4.

As shown in FIG. 1, an outlet pipe 6 is mounted at the bottom of the pit and is connected through suitable piping to an above-ground manure storage tank or to a suitable discharge conduit through which the slurry can be transferred to a mobile spreading unit.

The pipe 6 is adapted to be connected to the outlet 7 of a pump 8, as the pump is lowered within the pit. Pump 8 is provided with a lower axial inlet 9 through which a slurry is introduced into the pump and the slurry is then discharged through outlet 7 to discharge pipe 6.

Pump 8 is operated through a motor 10 which is located above the pit and is connected to the pump through a drive shaft assembly 11.

To agitate the slurry within pit 2, the pump and motor unit is adapted to be moved vertically within the pit as well as rotated, as will be hereinafter described, so that the discharge outlet 7 of pump 8 can direct the slurry to all areas of the pit to thoroughly mix the slurry. When it is desired to pump the slurry from the pit, the pump is lowered to a position where the outer end of outlet 7 will automatically be placed into registry with the corresponding end of the pipe 6. To provide this connection, the adjacent ends of pipe 6 and outlet 7 are formed with inclined or wedge-shaped surfaces as described in the aforementioned patent application.

To guide the motor-pump unit in vertical movement a generally C-shaped bracket 12 is attached to the side of pump 8 opposite the discharge outlet 7 and rides on column 5. In addition, the upper portion of the motor-pump unit is guided for vertical sliding movement on column 5 by trunion guide assembly 13. Trunion guide assembly 13 includes a trunion 14, as described in the aforementioned patent application, that enables the motor-pump unit to be tilted in a vertical plane.

Figure 2:
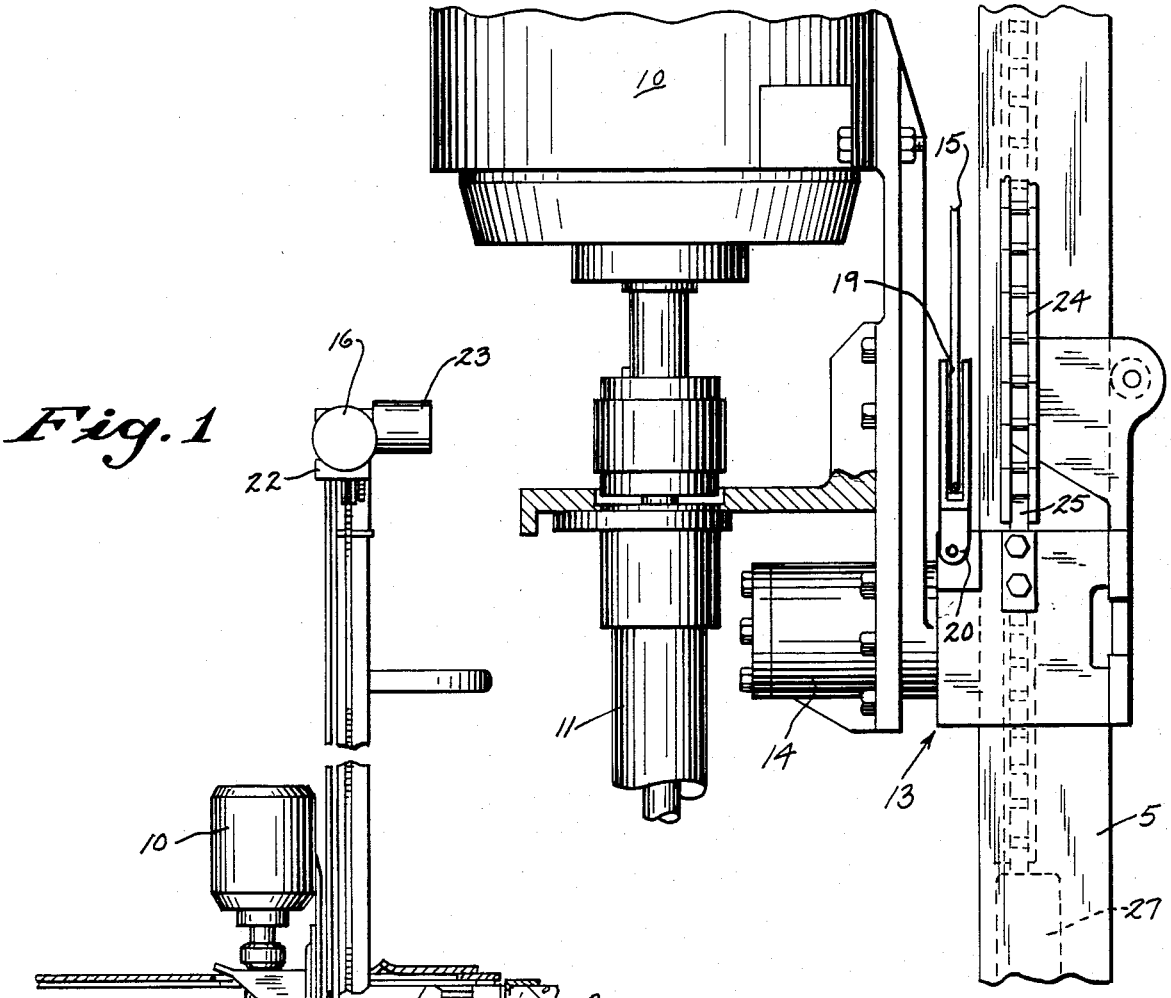
FIG. 2 is a side elevation, with parts broken away, showing the trunion assembly and the connection of the cable and chain to the trunion.
Figure 3:
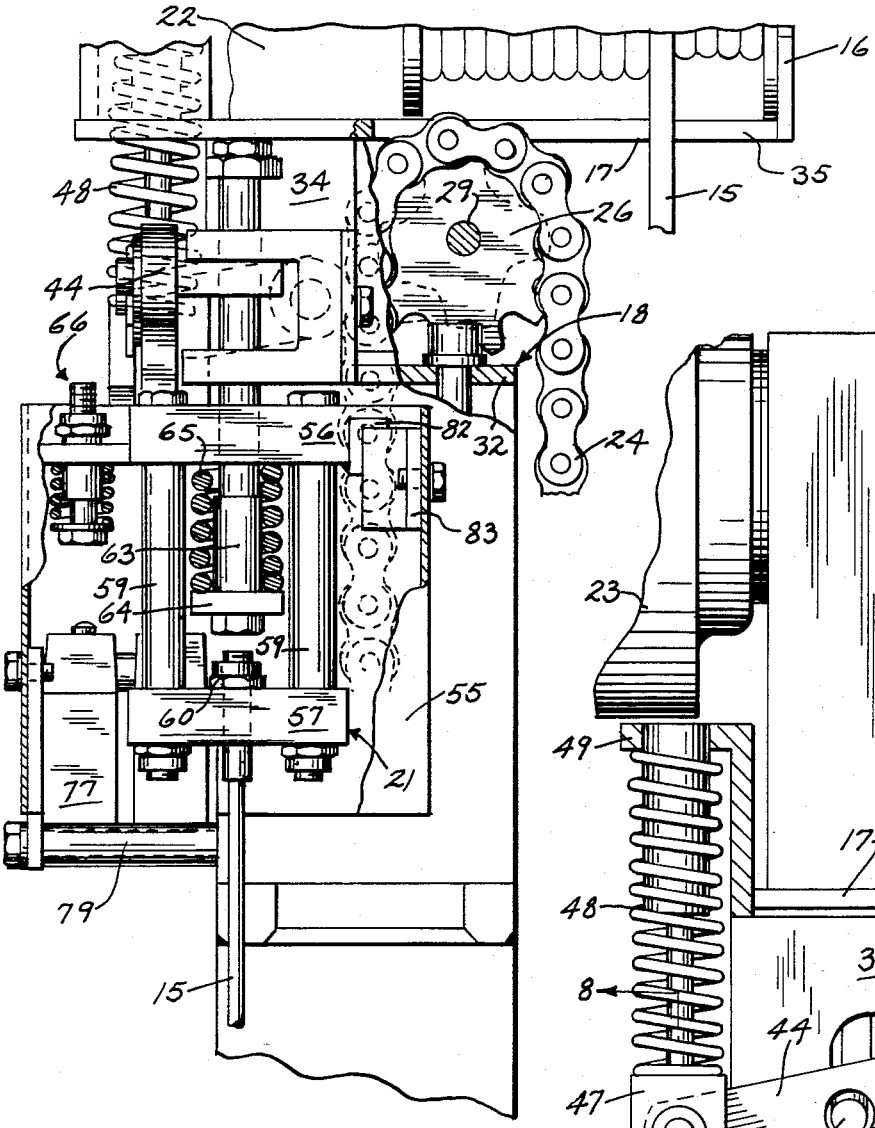
FIG. 3 is a front elevation, with parts broken away, showing the upper end of the column.

To raise and lower the motor-pump unit, a cable 15 is wound on a drum 16 that is mounted on the upper plate 17 of frame 18 attached to the upper end of column 5. Cable 15 extends downwardly from drum 16 around a pulley 19 attached through bale 20 to trunion guide assembly 13, as shown in FIG. 2, and then extends upwardly to frame 18. As shown in FIG. 3, the free end of cable 15 is dead ended on a switch assembly 21 mounted beneath plate 17 on upper frame 18.

As shown in FIG. 1, the shaft of drum 16 is operably connected through gear box 22 to reversible motor 23. Both gear box 22 and motor 23 are mounted on upper plate 17. Through this drive mechanism, cable 15 can be wound and unwound on drum 16 to thereby raise and lower the motor-pump unit.

As previously noted, the pump is adapted to be raised and lowered within the pit to agitate the slurry and the pump can also be raised to a location above the pit where the motor-pump unit can be tilted so that the pump can be serviced or maintained. With this arrangement, the pump can be moved through a substantial vertical distance which may be up to about six feet. As the motor-pump unit has considerable weight, the pump could be damaged severely if it would fall to the bottom of the pit or to the ground due to cable breakage or a malfunction in the drive system. Thus, in accordance with the invention, a mechanism is incorporated which will arrest the free descent of the motor-pump unit in the event of a malfunction in the drive system. More particularly, this mechanism includes a chain 24 having one end connected to a generally square pin 25 attached to trunion guide assembly 13, as shown in FIG. 2. Chain 24 is trained over a sprocket 26 (see FIG. 3) which is mounted for rotation on frame 18 and the opposite end of the chain is connected to the upper end of an elongated weight 27 which is mounted for movement within the hollow column 5, as best illustrated in FIG. 2.

As shown in FIG. 6, sprocket 26 is integral with a ratchet wheel 28, both of which are mounted for rotation on shaft 29 that extends between walls 30 and 31 of frame 18. As shown in FIG. 6, walls 30 and 31 extend upwardly from horizontal plate 32 of frame 18. Plate 32 is provided with an opening 33 through which the chain 24 extends as it travels over sprocket 26.

Plate 32 of frame 18 is supported on the upper end of column 5, and is connected to upper plate 17 by vertical wall or housing 34. Upper plate 17 is provided with a slot 35 through which the cable 15 passes, as shown in FIGS. 3 and 5.

With the construction as described, the cable drive system will raise and lower the motor-pump unit and chain 24 will travel in accordance with movement of the motor-pump unit, with counterweight 27 moving vertically within column 5.

As best shown in FIG. 7, a pawl 36 is mounted on a shaft 37 which extends outwardly from wall 30 of frame 18. The end 38 of pawl 36 is adapted to be moved into engagement with one of a series of lugs 39 on ratchet wheel 28. During normal operation of the cable drive system, the pawl 36 will be in an inoperative position, in which the end 38 will be out of engagement with the lugs 39, on the ratchet wheel. However, if a slackening in cable 15 occurs, the pawl 36 will be automatically pivoted to a locking position, as shown in FIG. 7, in which end 38 will engage one of the lugs 39 to prevent rotation of the ratchet wheel 28 and the interconnected sprocket 26. This will lock the chain 24, and as the chain is connected to the motor-pump unit, further descent of the motor-pump unit will be prevented.

To pivot the pawl from the release to the locking position, an extension 40 of pawl 36 extends through a hole 41 in wall 34 of frame 18 and projects into an opening 43 in a pivoting link 44, as shown in FIG. 7. The central portion of link 44 is pivoted to wall 34 through pivot pin 45. One end of link 44 is connected by pivot 46 to clevis 47 and spring 48 is interposed between clevis 47 and a spring cap or retainer 49 that is connected to upper plate 17. The force of the spring 48 will urge the link 44 counterclockwise, as shown in FIG. 4.

As shown in FIG. 9, the opposite end of link 44 is connected by connector 50 to the central portion of vertical rod assembly 51 that is mounted for sliding movement within aligned openings in arms 52 of block 53. Block 53 is supported from plate 32. The upper end of rod assembly 51 carries a pair of threaded nuts 54.

Figure 4:
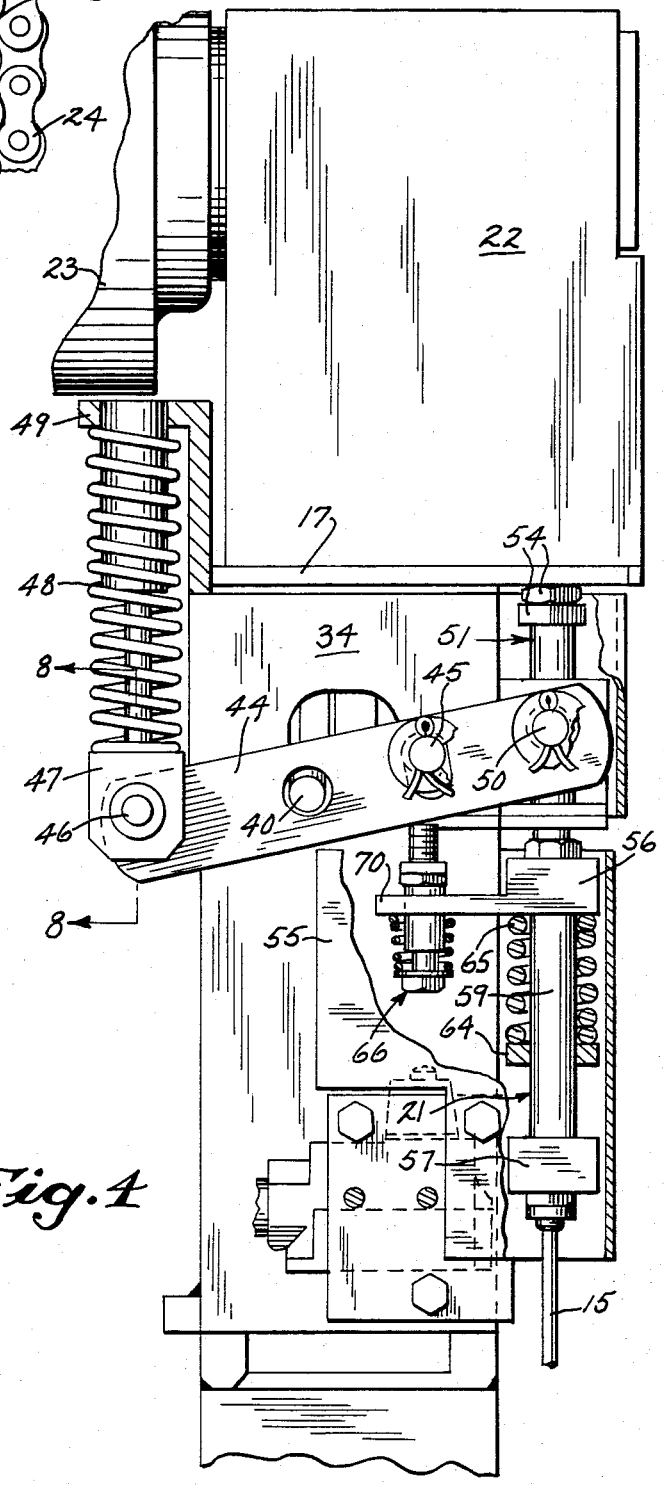
FIG. 4 is an end view of the structure shown in FIG. 3.

When there is no tension on cable 24, spring 48 will urge the link 44 counterclockwise, as shown in FIG. 4, to a position where connector 50 is in contact with the lower surface of upper arm 52. Under normal operating conditions, the weight of the motor-unit is applied to cable 24, and rod assembly 51 will be moved downwardly, as will be hereinafter described, to pivot the link 44 clockwise against the force of spring 48. Downward movement of rod assembly 51 is limited by engagement of the lower nut 54 with the upper arm 52.

In the event there is a slackening of the cable 24, as could occur if the cable breaks or comes off the pulley, the force of spring 48 will overcome the tension on the cable, thereby pivoting link 44 counterclockwise as shown in FIG. 4. As pawl 36 is connected to link 44 through extension 40, pivoting of link 44 will correspondly pivot pawl 36 about shaft 37 and bring the end 38 of the pawl into engagement with one of the lugs 39 to thereby restrict further rotation of the ratchet wheel 28 and connecting sprocket 26. This action will prevent movement of chain 24 and as the chain is directly connected to the motor-pump unit, the free descent of the motor-pump unit will be arrested.

In accordance with a feature of the invention, switch assembly 21 acts to automatically disconnect the operation of the motor 24 in the event of slackening of the drive cable 15, or in the event of excessive tension being applied to cable 15. The switch assembly 21 is located within guard 55 attached to the upper end of column 5. Switch assembly 21 includes an upper bar 56 and a lower bar 57 which is connected to upper bar 56 through tie rods 58. Spacer sleeves 59 are positioned around tie rods 58 and extend between the upper and lower bars 56 and 57.

Figures 10, 11, 12:
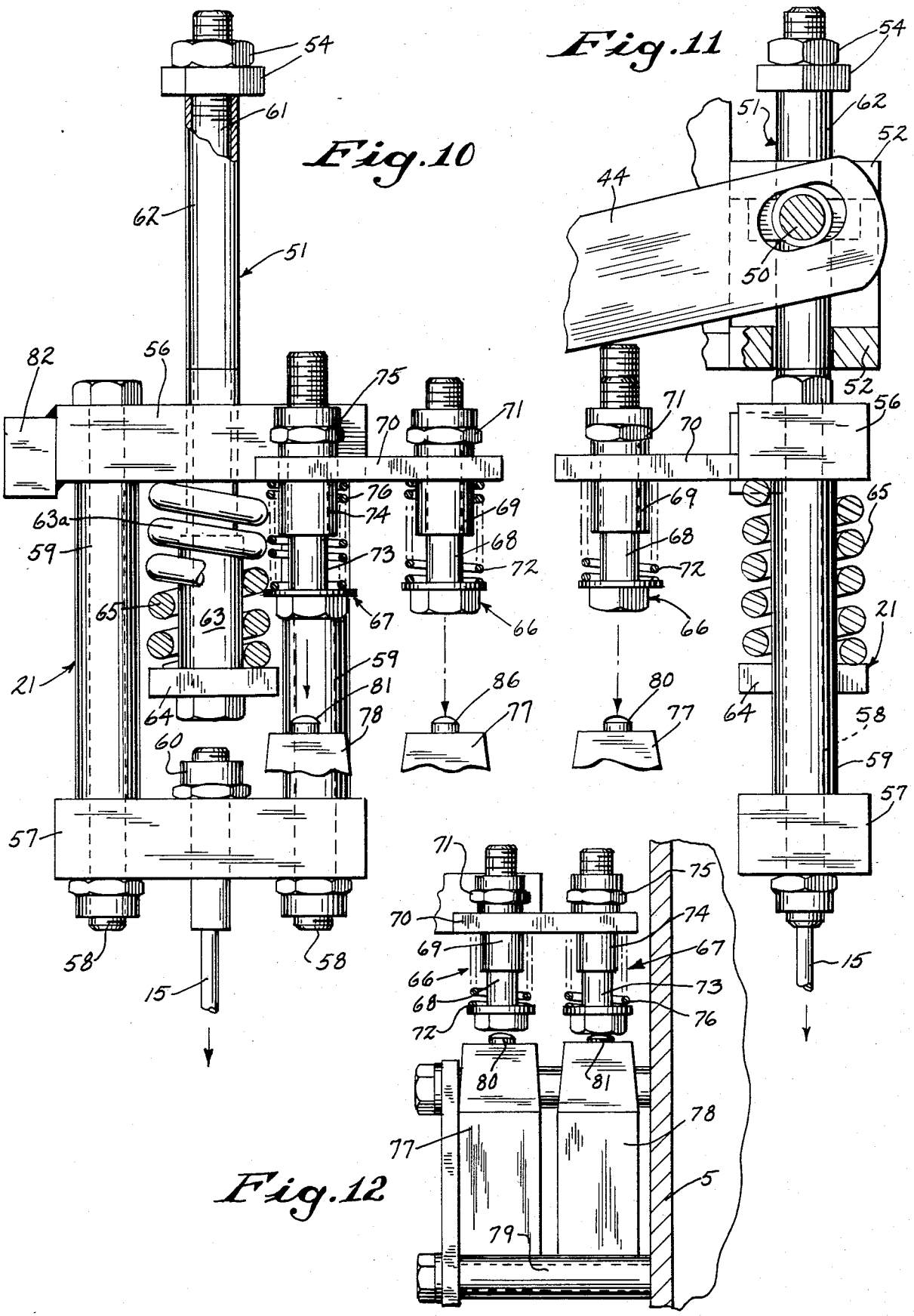
FIG. 10 is an enlarged rear elevation of the tension sensing mechanism for the cable with the mechanism shown in a slack condition of the cable.
FIG. 11 is an end view of the structure of FIG. 10.
FIG. 12 is a front elevation of the switch assembly in a tensioned condition of the cable.

As shown in FIGS. 3 and 10, the free end of cable 15 is dead ended on the central portion of lower bar 57, as indicated by 60.

Rod assembly 51 comprises a bolt 61 and a pair of sleeves 62 and 63 are located around bolt 61 and extend between nuts 54, which are threaded on the upper end of bolt 61, and seat 64 that bears against the head of the bolt. Lower sleeve 63 is mounted for sliding movement within bar 56 and is provided with a shoulder **63*a* located beneath bar 56. Compression spring 65 is interposed between the lower surface of upper bar 56 and seat 64**.

Switch assembly 21 also includes a pair of switch actuators 66 and 67. Actuator 66, which comes into play when excessive tension is applied to the cable 15, is composed of a stud 68 that extends through a sleeve 69 welded within an opening in bracket 70 that extends outwardly from upper bar 56. The upper threaded end of stud 68 receives a retaining nut 71, while a compression spring 72 is positioned between the head of the stud and the undersurface of bracket 70. Spring 72 urges the head of stud 68 downwardly.

Switch actuator 67 is similar in construction to actuator 66 and comes into play when cable 15 slackens. Actuator 67 includes a stud 73, similar to stud 68, that extends through a sleeve 74 welded within an opening in bracket 70. The upper threaded end of stud 73 receives a retaining nut 75 and a compression spring 76 is located between the head of stud 73 and the undersurface of bracket 70. As in the case of spring 72, spring 76 urges the head of the stud downwardly.

Actuators 66 and 67 are adapted to engage switches 77 and 78 which are mounted in side-by-side relation on support 79 that extends outwardly from column 5. Switches 77 and 78 include spring loaded switch elements 80 and 81, respectively, which extend upwardly from the respective switches.

As cable 15 may tend to twist during operation, the twisting of the cable may tend to rotate the switch assembly 21 causing misalignment of the actuators 66 and 67 with the corresponding switch elements 80 and 81. To prevent rotation of the switch assembly, a lug 82 extends outwardly from the upper bar 56 and is adapted to engage a bracket 83 on column 5 to prevent rotation of the assembly and maintain alignment of the switches and actuators.

In normal operation of the apparatus, the weight of the motor-pump unit will apply tension to cable 15, and as the cable is dead-ended on lower bar 57 of switch assembly 21, the tension on cable 15 will pull the spring assembly downwardly until lower nut 54 carried on the upper end of rod assembly 51 engages upper arm 52. As previously described, the downward movement of rod assembly 51 of the switch assembly will pivot the link 44 against the force of the compression spring 48.

Downward movement of switch assembly 21 caused by tension on cable 15 will move actuators 66 and 67 downwardly to the position shown in FIG. 12, in which actuator 67 is engaged with the switch element 81 of switch 78. However, in this position, the actuator 66 is not engaged with the switch element 80 of switch 77.

If cable 15 should slacken, as for example, by breakage of the cable, or jumping of the cable from the pulley, tension on the cable will be released and the switch assembly 21 will move upwardly under the force of spring 48. As previously described, spring 48 will pivot the link 44 counterclockwise, as shown in FIG. 4, and as the end of link 44 is connected to rod assembly 51, the rod assembly 51 and spring assembly 21 will move upwardly thereby deactivating the switch 78. Deactivating switch 78 will cause power to be shut off to the winch motor 23 so that the cable will not continue to be unwound from the drum. Thus slackening of cable 15 will automoatically discontinue operation of the cable drum drive, so that the cable will not continue to be unwound from the drum, thereby preventing entanglement of the cable. For example, if the cable should break, continued operation of the motor 23 will unwind the cable and cause possible entanglement of the unwound cable. Similarly, if the pump is lowered through the cable drive to a rest position, either at the bottom of the pit or on the ground, continued operation of the motor will cause the cable to unwind with the result that entanglement could occur. The invention remedies this situation in that the motor is automatically stopped when slack occurs in cable 15.

If a situation arises where excessive tension is applied to cable 15, operation of the winch motor 23 will similarly be discontinued. For example, if, when the motor-pump unit is being raised within the pit, the pump should catch on a fixed object, continued operation of the winch can cause excessive tension on the cable. Similarly, when the motor-pump unit is at its maximum upper position, continued operation of the winch motor can cause excessive tension on the cable. In this situation, the excessive tension will act to lower the interconnected bars 56 and 57, relative to rod assembly 51 and against the force of compression spring 65. At this time, the nut 54 is in engagement with arm 52, so rod assembly 51 cannot be lowered.

However, lowering of the bars 56 and 57 relative to rod assembly 51 will cause the actuator to be further lowered to bring the actuator 66 into contact with switch element 80, thereby activating switch 77 and shutting off power to the winch motor 23. Engagement of upper bar 56 with shoulder 63*a* on sleeve 63 will limit the downward movement of the rod assembly 51. Thus, the mechanism automatically discontinues operation of the winch motor in the event excessive tension is applied to cable 15.

Springs 72 and 76 associated with switch actuators 66 and 67 provide an overriding or cushioning effect for the actuators on engagement with the respective switch elements.

As an added feature, the descent arresting mechanism will automatically release and reset when the pump is raised and tension is restored in the cable. For example, if cable 15 should break and a new cable is substituted, restored tension in the cable caused by the weight of the motor-pump unit will immediately pivot link 44 and pawl 36 to its release position to thereby unlock the descent arresting mechanism. Restoring tension on the cable will also move the actuators to the position shown in FIG. 12, where switch element 81 is actuated to restore power to the winch motor 23 so that the motor-pump unit can then be raised and lowered.

Various modes of carrying out the invention are contemplated as being within the scope of the following claims particularly pointing out and distinctly claiming the subject matter which is regarded as the invention.

I claim:

1. An apparatus for retaining the vertical position of an object, comprising an object having a considerable mass, a fixed supporting structure including a generally vertical column, means for mounting the object for vertical movement relative to said column, drive means for raising and lowering the object and including a flexible member interconnected between the object and the supporting structure, the weight of the object applying substantial tension to said flexible member during normal operation of said drive means, descent arresting means operably connected to said object and responsive to slackening of said flexible member for arresting free descent of said object, and means responsive to the restoration of tension on said flexible member for releasing said descent arresting means.

2. The apparatus of claim 1, wherein said drive means includes a rotatable drum on which said flexible member is wound, and power means operably connected to the drum to rotate the drum and wind and unwind said flexible member, and means operable as a consequence of slackening of said flexible member to discontinue operation of said power means.

3. The apparatus of claim 1, wherein said descent arresting means comprises a second flexible member having one end connected to said object and being movable in a path of travel in accordance with movement of said first flexible member, and locking means mounted for movement between a locking position, wherein said locking means engages said second flexible member to prevent movement of said second flexible member and thereby prevent movement of said first flexible member, and a release position, slackening of said first flexible member acting to move said locking means from the release to the locking position.

4. The apparatus of claim 3, wherein said second flexible member comprises a chain having one end connected to said object and the opposite end connected to a weight, and a sprocket mounted on the supporting structure to support said chain in travel.

5. In an apparatus for agitating and pumping liquid manure slurry, a vessel to contain a liquid manure slurry, a motor-pump unit for agitating and pumping said slurry, a fixed supporting column mounted within siad vessel, means for mounting the motor-pump unit for vertical movement relative to said column, drive means for raising and lowering the motor-pump unit in the vessel and including a cable connected to said motor-pump unit, said drive means also including a rotatable drum mounted on the supporting column, said cable being wound on said drum, the weight of the motor-pump unit applying substantial tension to said cable during normal operation of said apparatus, means operably connected to said motor-pump unit and responsive to slackening of said cable for arresting free descent of said motor-pump unit, said means responsive to slackening of said cable comprises a chain having one end connected to the motor-pump unit and disposed to move in a path of travel in accordance with movement of said cable, and locking means mounted for movement between a locking position wherein said locking means engages said chain to prevent movement of said chain and thereby prevent corresponding movement of said cable and a release position, and means operable as a consequence of slackening of the cable for moving said locking means from the release to the locked position, and means responsive to restoration of tension on said cable for releasing said locking means.

6. The apparatus of claim 5, wherein said drive means includes a power unit operably connected to said drum to rotate said drum and thereby wind and unwind said cable, and said apparatus also has means responsive to slackening of said cable for discontinuing operation of said power unit.

7. An apparatus for positioning an object, comprising an object having considerable mass and disposed to move in a generally vertical path, a fixed supporting structure including a generally vertical column, means for mounting the object for vertical movement relative to said column, drive means operably connected to said object for raising and lowering the object and including a flexible member interconnected between the object and the supporting structure, the weight of said object applying a predetermined tension to said flexible member during normal operation of said drive means, means responsive to a decrease in tension on said flexible member below said predetermined tension for discontinuing operation of said drive means, and means responsive to an increase in tension on said flexible member above said predetermined tension for discontinuing operation of said drive means.

8. The apparatus of claim 7, and including descent arresting means operably connected to said object and movable between a descent arresting position and a release position, said means responsive to a decrease in tension disposed to move said descent arresting means from the release position to the descent arresting position to thereby prevent free descent of said object.

9. In an apparatus for agitating and pumping liquid manure slurry, a vessel to contain a liquid manure slurry, a motor-pump unit for agitating and pumping said slurry, a fixed supporting column mounted within said vessel, means for mounting the motor-pump unit for vertical movement relative to said column, drive means for raising and lowering the motor-pump unit in the vessel and including a cable interconnected with said motor pump unit, the weight of the motor pump unit applying a predetermined tension to said cable during normal operation of said apparatus, means operably connected to said motor-pump unit and responsive to a decrease in tension below said predetermined tension for arresting free descent of said motor-pump unit, and second means responsive to a decrease in tension beneath said predetermined tension and operably connected to said drive means for discontinuing operation of said drive means.

10. The apparatus of claim 9, and including means responsive to an increase in tension on said cable above said predetermined tension for discontinuing operation of said drive means.

11. An apparatus for retaining the vertical position of an object comprising an object having considerable mass, a fixed supporting structure, means for mounting the object for vertical movement relative to said structure, drive means for raising and lowering the object and including a flexible member interconnected between the object and the supporting structure, the weight of the object applying substantial tension to said flexible member during normal operation of said drive means, descent arresting means operably connected to said object and responsive to slackening of said flexible member for arresting free descent of said object, said descent arresting means comprising a second flexible member having one end connected to said object and being movable in a path of travel in accordance with movement of said first flexible member, said descent arresting means also including locking means mounted for movement between a locking position wherein said locking means engages said second flexible member to prevent movement of said second flexible member and thereby prevent movement of said first flexible member and a release position, slackening of said first flexible member acting to move said locking means from the release to the locking position, said second flexible member comprising a chain having one end connected to said object and the opposite end connected to a weight and a sprocket mounted on the supporting structure to support said cable in travel, said locking means comprising a first locking element secured to the sprocket and a second locking element engageable with said first locking element when said locking means is in the locked position, and a link pivotally connected to the supporting structure, biasing means operably connected to one end of the link to urge the link in one direction, said first flexible member being connected to the opposite end of said link and arranged so that the weight of said object exerts a force on said link opposed to the force exerted by said biasing means and greater than the force of said biasing means, said second locking element being connected to said link, slackening of said first flexible member removing the force exerted by said object on said link and enabling said biasing means to pivot said link and thereby move said second locking element into engagement with said first locking element.

* * * * *